US010748694B2

(12) United States Patent
Ogawa

(10) Patent No.: US 10,748,694 B2
(45) **Date of Patent: *Aug. 18, 2020**

(54) COIL COMPONENT

(71) Applicant: TAIYO YUDEN CO., LTD., Taito-ku, Tokyo (JP)

(72) Inventor: Hideki Ogawa, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 254 days.

This patent is subject to a terminal disclaimer.

(21) Appl. No.: 15/595,575

(22) Filed: May 15, 2017

(65) Prior Publication Data

US 2017/0250021 A1 Aug. 31, 2017

Related U.S. Application Data

(63) Continuation of application No. 14/839,799, filed on Aug. 28, 2015, now Pat. No. 9,685,263.

(30) Foreign Application Priority Data

Aug. 30, 2014 (JP) ..... 2014-176673
Aug. 4, 2015 (JP) ..... 2015-153929

(51) Int. Cl.

| | |
|---|---|
| ***H01F 17/04*** | (2006.01) |
| ***H01F 1/14*** | (2006.01) |
| ***H01F 1/147*** | (2006.01) |
| ***H01F 1/153*** | (2006.01) |

(52) U.S. Cl.

CPC ..... *H01F 17/04* (2013.01); *H01F 1/14* (2013.01); *H01F 1/14708* (2013.01); *H01F 1/14733* (2013.01); *H01F 1/14766* (2013.01); *H01F 1/14791* (2013.01); *H01F 1/15325* (2013.01); *H01F 1/15375* (2013.01); *H01F 17/045* (2013.01); *H01F 2017/048* (2013.01)

(58) Field of Classification Search

None

See application file for complete search history.

(56) References Cited

U.S. PATENT DOCUMENTS

| | | | | |
|---|---|---|---|---|
| 7,132,019 | B2 * | 11/2006 | Koshiba | H01F 1/15308 148/304 |
| 8,854,173 | B2 * | 10/2014 | Tsuchiya | B22F 1/0003 336/233 |
| 9,222,145 | B2 * | 12/2015 | Ohta | B82Y 25/00 |
| 9,685,263 | B2 * | 6/2017 | Ogawa | H01F 1/14708 |
| 2002/0057982 | A1 | 5/2002 | Kuniyoshi et al. | |
| 2002/0117235 | A1 * | 8/2002 | Kanekiyo | B82Y 25/00 148/101 |
| 2009/0302512 | A1 * | 12/2009 | Gablenz | C04B 35/632 264/612 |
| 2010/0289366 | A1 | 11/2010 | Komuro et al. | |
| 2012/0038449 | A1 | 2/2012 | Ogawa et al. | |
| 2012/0092111 | A1 * | 4/2012 | Tsuchiya | C21D 6/00 336/83 |
| 2012/0145944 | A1 | 6/2012 | Komuro et al. | |
| 2013/0076477 | A1 * | 3/2013 | Kino | C22C 1/02 336/233 |
| 2013/0082815 | A1 | 4/2013 | Ogawa | |
| 2013/0176098 | A1 * | 7/2013 | Matsuura | H01F 27/255 336/221 |
| 2013/0228717 | A1 * | 9/2013 | Harada | H01F 1/26 252/62.55 |
| 2013/0300531 | A1 | 11/2013 | Tsuchiya et al. | |
| 2014/0104031 | A1 * | 4/2014 | Ogawa | B22F 1/02 336/221 |
| 2016/0086728 | A1 * | 3/2016 | Suetsuna | B22F 9/04 148/105 |

FOREIGN PATENT DOCUMENTS

| | | | |
|---|---|---|---|
| CN | 101377975 | A | 3/2009 |
| CN | 102268605 | A | 12/2011 |
| CN | 102969109 | A | 3/2013 |
| CN | 103298966 | A | 9/2013 |
| CN | 103650074 | A | 3/2014 |
| JP | 2007231415 | A | 9/2007 |
| JP | 2012238828 | A | 12/2012 |
| JP | 2013067863 | A | 4/2013 |
| JP | 2013145866 | A | 7/2013 |
| WO | 2012098817 | A1 | 7/2012 |

OTHER PUBLICATIONS

Abstract Translation of JP 5032711 B1 (Year: 2012).*

Non-Final Office Action issued by U.S. Patent and Trademark Office, dated Aug. 8, 2016, for related U.S. Appl. No. 14/839,799.

(Continued)

*Primary Examiner* — Kevin M Bernatz

(74) *Attorney, Agent, or Firm* — Law Office of Katsuhiro Arai

(57) ABSTRACT

A coil component is constituted by a composite magnetic material containing alloy grains whose oxygen atom concentration in their surfaces is 50 percent or less, and resin, and also by a coil. The alloy grains are comprised of first alloy grains and second alloy grains which have different compositions and different average grain sizes. The coil component using the composite magnetic material does not require high pressure when formed.

16 Claims, No Drawings

(56) References Cited

OTHER PUBLICATIONS

Notice of Allowance issued by U.S. Patent and Trademark Office, dated Feb. 16, 2017, for related U.S. Appl. No. 14/839,799.
A First Office Action issued by the State Intellectual Property Office of China dated Jul. 1, 2019 for Chinese counterpart application No. 201711163511.5 (9 pages).
A Notice of Reasons for Refusal issued by the Japanese Patent Office, dated Jun. 14, 2019, for related Japanese application No. 2018-230478 (5 pages).
A Decision of Refusal issued by the Japanese Patent Office, dated Oct. 25, 2019, for Japanese counterpart application No. 2018-230478. (6 pages).

* cited by examiner

COIL COMPONENT

CROSS-REFERENCE TO RELATED APPLICATIONS

This application is a continuation of U.S. patent application Ser. No. 14/839,799, filed Aug. 28, 2015, which claims priority to Japanese Patent Application No. 2015-153929, filed Aug. 4, 2015, and No. 2014-176673, filed Aug. 30, 2014, each disclosure of which is herein incorporated by reference in its entirety.

The applicant herein explicitly rescinds and retracts any prior disclaimers or disavowals made in any parent, child or related prosecution history with regard to any subject matter supported by the present application.

BACKGROUND

Field of the Invention

The present invention relates to a composite magnetic material containing metal magnetic grains and resin; a magnetic body made of such composite magnetic material formed in a specified solid shape; and a coil component constituted by such magnetic body.

Description of the Related Art

Electronic devices such as mobile devices are becoming increasingly high-performance, and therefore high performance is also required for components used in these devices. In addition, the current trend is to install more parts in electronic devices, which is accelerating the move toward smaller components. In particular, high performance is also required for small components for which ferrite has often been used, such as those of 3 mm or smaller in size, and use of metal magnetic material is considered.

As for coil components using metal magnetic material, a method is available whereby a coil is embedded in an alloy powder compact, as described in Patent Literature 1. As part of the art of Patent Literature 1, use of alloy powder of relatively small grains is considered to reduce losses. However, simply reducing the grain size increases the specific surface area, which in turn reduces the moldability. As a result, high molding pressure has to be applied to form a powder compact.

BACKGROUND ART LITERATURES

[Patent Literature 1] Japanese Patent Laid-open No. 2013-145866

SUMMARY

According to a conventional method, however, very high molding pressure of 600 MPa, for example, is required, as illustrated by an example cited in Patent Literature 1, and the stress received by the coil cannot be ignored at such pressure. In particular, a coil made of thin conductive wire deforms or breaks easily. Because of this prerequisite of high molding pressure, usable conductive wires are limited. Also, applying high pressure causes the alloy grains to receive stress, which sometimes leads to lower magnetic permeability. Another method is to provide surface treatment on metal magnetic grains. For example, use of coupling agent results in better wettability of metal magnetic grains and stable composite magnetic materials can be obtained. Under this method, too, however, the fill ratio of alloy grains drops due to the presence of coupling agent.

In view of the above, one important factor of size reduction is to form a magnetic body without relying on high pressure. An object of the present invention is to provide a composite magnetic material that does not require high pressure when formed, as well as a coil component having such composite magnetic material.

Any discussion of problems and solutions involved in the related art has been included in this disclosure solely for the purposes of providing a context for the present invention, and should not be taken as an admission that any or all of the discussion were known at the time the invention was made.

One forming method for a magnetic body that does not require high pressure is hot forming, where a composite magnetic material constituted by metal magnetic grains and resin is used and the resin is melted. In hot forming, the percentage of resin must be increased, and increasing the fill ratio of metal magnetic grains is difficult, unlike in powder compacting. Accordingly, the inventors of the present invention studied the premise of not increasing the percentage of additives other than metal magnetic grains. As a result, it was found that the oxidization state of the surface of metal magnetic grains affects the fluidity of a composite magnetic material constituted by magnetic grains and resin, and also improves its filling property. To be specific, less oxygen at the surface of metal magnetic grains improves the affinity of these grains with the resin, and the viscous property of the composite magnetic material in which the metal magnetic grains are mixed drops. In other words, lowering the viscous property of the composite magnetic material constituted by such magnetic grains and resin has been found to improve the fluidity of the material, which makes dense filling possible.

Starting from the aforementioned knowledge and studying it further in earnest, the inventors of the present invention completed the present invention as described below:

(1) A coil component constituted by a composite magnetic material containing alloy grains and resin and also by a coil, wherein the coil component is such that the oxygen atom concentration in the surface of the alloy grains is 50 percent or less.

(2) A coil component according to (1), wherein the oxygen atom concentration is 30 to 40 percent.

(3) A coil component according to (1) or (2), wherein the coil component has a coil embedded in the composite magnetic material.

(4) A coil component according to (1) or (2), wherein the coil component has a coil formed inside the composite magnetic material.

According to the present invention, use of alloy grains whose surface has an oxygen atom concentration of 50 percent or less improves the wettability of the alloy grain surface and resin. This composite magnetic material has lower viscous resistance, which in turn improves the fluidity of the material and allows for dense filling of alloy grains even at low pressure or no pressure, and consequently the problem of lower magnetic permeability can be resolved without generating stress in the grains. By compositing these metal magnetic grains and resin this way, a coil component offering high resistance and high performance can be obtained. According to a favorable embodiment, the composite magnetic material uses alloy grains with an oxygen atom concentration of 30 to 40 percent, as this makes stable filling possible without increasing the amount of resin, and a high fill ratio can be maintained even when the thickness of the magnetic body is only around 0.2 mm, for example.

This, in particular, allows for production of small components of low product height not heretofore possible.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

DETAILED DESCRIPTION OF EMBODIMENTS

The coil component proposed by the present invention is constituted by a composite magnetic material containing resin and alloy grains.

The alloy grains are made of a material whose composition is such that it expresses magnetism in unoxidized metal areas, where examples include unoxidized alloy grains and unoxidized alloy grains having oxide, etc., provided around them. To be specific, any known method for manufacturing alloy grains may be adopted, or any commercial product may be used such as PF-20F manufactured by Epson Atmix or SFR-FeSiCr manufactured by Nippon Atomized Metal Powders. It should be noted, however, that traditionally, alloy grains contain approximately 50 to 90 percent by weight of iron (elemental Fe), and many also contain 10 percent by weight or more of elements other than iron (elemental Fe). Percentages of such elements as chromium (Cr) and silicate (Si) are often increased for greater insulation, smaller core loss, etc. Because of this, ways to enhance the insulation property of the grain surface have been examined for conventional compositions, such as utilizing alloy grains whose surface physically oxidizes easily or heat-treating and thereby oxidizing the surface of alloy grains. As a result, these alloy grains have a high oxygen atom concentration in their surface, which increases the viscous resistance of the composite magnetic material and makes it unsuitable for applications where pressure is not applied.

Accordingly, preferably the content of Fe is high in the alloy grain composition. Amorphous alloy grains contain 77 percent or more by weight of Fe, while crystalline alloy grains contain 92.5 percent by weight or more of Fe, and impurities such as Mn, P, S, Mo, and other elements may also be contained. In addition, the content of Fe is 79.5 percent by weight or less for amorphous alloy grains, but 95.5 percent by weight or less for crystalline alloy grains, and with these Fe contents insulation property can be secured easily. In addition to Fe, substances that are oxidized more easily than Fe, such as Al and Cr, may be contained. Ideally the total content of any of non-Fe elements such as Si, Al, Cr, Ni, Mo, and Co is 5 to 10 percent by weight. This way, excessive oxidization of the alloy grain surface can be suppressed and a stable oxygen atom concentration can be achieved. For example, any powder manufactured by the gas atomization method or powder manufactured by the water atomization method can be heat-treated in a reducing ambience as a way to adjust the oxygen atom concentration. Here, too little oxygen in the surface of alloy grains lowers the resistance, thus making it necessary to increase the amount of resin or percentage of constituents other than metal magnetic grains in order to ensure enough resistance value, which ultimately leads to a lower fill ratio. Accordingly, preferably the oxygen atom concentration is adjusted to 30 percent or more in ion ratio. Alloy grains include, for example, those made of crystalline alloys such as FeSiCr, FeSiAl, and FeNi, and others made of amorphous alloys such as FeSiCrBC and FeSiBC.

Also, material made by mixing alloy grains from two or more of these alloys or made by mixing in Fe grains may be considered, among others, and preferably grains of different grain sizes and compositions are combined to provide the required characteristics. More preferably these metal magnetic grains have a spherical shape. This is because the smaller the grain surface area, the smaller the amount of oxygen at the grain surface, and it also becomes possible to minimize the range of the grain surface where oxygen is present and to increase the percentage of metal areas in the grain. The same is true with the surface roughness of the grain, where ideally the grain surface is smooth and preferably the surface roughness Ra is 1 nm to 100 nm.

The oxygen atom concentration of an alloy grain is measured by secondary ion mass spectrometry (TOF-SIMS: time-of-flight secondary ion mass spectrometry) using the TRIFT-II manufactured by Ulvac Phi. Under TOF-SIMS, pulsed primary ion beam is irradiated onto the surface layer of a sample (alloy grain), and as the ions in the beam clash with the sample surface at molecular and atomic levels, the surface layer of the sample is agitated and the resulting secondary ions are detected by a time-of-flight mass spectrometer (TRIFT-II manufactured by Ulvac Phi), for qualification and quantification of solid contents. The quantified oxygen ion concentration corresponds to the ratio of oxygen to the total amount of detected secondary ions.

Under the present invention, the oxygen atom concentration at the alloy grain surface is set to be 50 percent or less. Preferably it is set to 30 to 40 percent. The oxygen atom concentration at the alloy grain surface indicates a value obtained by capturing how the oxygen atom concentration changes at each depth as measured from the surface layer to the interior of the alloy grain. This detection is made by irradiating primary gallium ion beam under the conditions of acceleration voltage of 15 kV, pulse width of 13 nsec and ion beam pulse current of 600 pA, irradiation time of 60 sec, and irradiation angle of 40 deg (angle to the secondary ion detector), and then detecting, from the detected secondary ions, the ion count for each constituent present in the surface layer of the sample and obtaining the oxygen atom concentration based on the ion count for each constituent. To obtain the concentration of oxygen atoms present in the surface layer toward the interior of the sample, the surface layer of the sample must be etched, and this etching is done by continuously irradiating gallium sputter ions under the conditions of acceleration voltage of 15 kV and ion beam current of 600 pA. Detection and etching are performed alternately for 60 sec each, and detection is performed for each etching period consisting of 0 minutes (before etching by sputter ion irradiation) to 30 minutes in 1-minute increments. In other words, constituents can be detected at each depth from the surface layer of the alloy. Also, each ion irradiation was performed in a range of 1 to 5 μm. The metal magnetic grains measured were adjusted to within this range. Also, while this measurement is possible in the metal magnetic grain stage, a magnetic body containing organic constituents, for example, can also be subjected to the above measurement, wherein the magnetic body is fractured to expose grain surfaces which tend to have less organic constituents stuck thereto where its organic constituents and other constituents not derived from metal magnetic grains do not exceed approximately 20 percent by weight relative to the weight of metal magnetic grains. In the above, even a magnetic body can be measured wherein the surface of a metal magnetic grain identified by observing the fractured surface is used for measurement.

Each oxygen atom concentration based on detected secondary ions becomes the largest within 10 minutes, or preferably 1 to 5 minutes, of cumulative etching time by sputter ion irradiation. Here, a cumulative etching time of within 10 minutes was assumed to represent the alloy grain surface. With the alloy grains under the present invention, because the maximum oxygen atom concentration can be obtained in cumulative etching time of within 10 minutes, the oxygen atom concentration can be correctly evaluated as that in the grain surface by the above method.

In conclusion, the "oxygen atom concentration in the alloy grain surface" indicates the maximum value of oxygen atom concentration obtained within 10 minutes (cumulative etching time) from the start of etching, from among the oxygen atom concentrations obtained at 1-minute increments before and after etching as described above.

In other words, the oxygen atom concentration in the alloy grain surface is designed. This way, the wettability of resin is improved at the grain surface and the viscous resistance of the composite magnetic material is decreased. By reducing the amount of oxygen at the alloy grain surface, the number of hydroxyl groups at the alloy grain surface can be reduced and the film of water molecules decreased, thereby increasing the compatibility of the hydrophobic resin and metal interface to improve the wettability of the alloy grain surface and resin. As a result, the viscous resistance of the composite magnetic material becomes lower and its fluidity improves, and the alloy grains can be filled densely even at low pressure or no pressure, which prevents generation of stress in the grain and solves the problem of lower magnetic permeability. Consequently, the fluidity increases and dense filling is achieved at low pressure. In addition, the oxygen atom concentration in the alloy grain surface peaks within 10 minutes of cumulative etching time, i.e., in the surface layer of the alloy grain (from the surface to a depth reached by the etching), and peaks of elements other than Fe are also found around here. The specific elements other than Fe are determined by the composition of the alloy grain, and may include Si, Al, Cr, Ni, Mo, and Co. The presence of oxygen and non-Fe elements at the alloy grain surface assures insulation property and helps suppress excessive oxidization. As a result, high resistance and high magnetic characteristics can be achieved when the grains are composited with the resin. The oxygen atom concentration is 50 percent or less, or preferably 30 to 40 percent. By adjusting the oxygen atom concentration to 50 percent or less in the surface layer ("in the surface"), the oxygen atom concentration at the surface of the grain (before etching) can be kept to 25 percent or less, effectively controlling the oxygen atom concentration at the grain surface at a low level. Typically, less oxygen is detected at the surface of the grain than beneath the surface in the surface layer having a nanometer-level thickness (due to the oxidation mechanisms of different elements and the existence of impurities such as C and H at the surface). Furthermore, by adjusting the oxygen atom concentration to 40 percent or less in the surface layer (or in the surface), the oxygen atom concentration at the surface of the grain (before etching) can be kept to 20 percent or below. Preferably the average time after the start of detection when the oxygen atom concentration becomes maximum with 20 or more metal magnetic grains (randomly selected) is within 10 minutes. Preferably, when 20 or more metal magnetic grains are randomly selected, metal magnetic grains having an average oxygen atom concentration of 50 percent or less account for 50 percent or more, more preferably 80 percent or more. Alternatively or additionally, the average oxygen concentration of 20 or more metal magnetic grains (randomly selected) may be 50 percent or less. The TOF-SIMS conditions here are such that, when etching sputter ions are irradiated onto the metal magnetic grains containing Fe by 77 percent by weight or more, the differences in the rate at which the surface layers of metal magnetic grains are shaved, among metal magnetic grains of different compositions, are within 5 percent and roughly constant even when the metal magnetic grains contain different non-Fe elements, respectively. Also, regarding the shaved amount of the metal surface layer, the detected secondary ions are converted to volume and the equivalent volume is divided by the irradiated area of primary ions, so that the shaved depth from the metal surface layer can be obtained. For example, when the cumulative etching time is 30 minutes, the shaved (etched) depth of grains is approximately 30 nm, and thus, regardless of the type of elements constituting the grains, the shaved depth for most metal magnetic grains by 30-minute etching can be evaluated at 30 nm±5%. Similarly, the shaved depth of grains by 10-minute etching can be evaluated at 10 nm±5%.

The composite magnetic material under the present invention must contain the alloy grains described above, and preferably the oxygen atom concentration of alloy grains accounting for 80 percent by volume or more in equivalent volume percentage, among all of the metal magnetic grains contained in the composite magnetic material, is 50 percent or less, preferably 30 to 40 percent. This way, the fill ratio can be increased and the inductance of the coil component can be raised.

The composite magnetic material under the present invention must contain the alloy grains described above, and preferably the average grain size of the alloy grains contained in the composite magnetic material is 2 to 20 μm. This way, core loss can be suppressed even when the fill ratio of the composite magnetic material is high.

Preferably the composite magnetic material contains first metal magnetic grains and second metal magnetic grains, where the average grain size of the first metal magnetic grains is different from that of the second metal magnetic grains. Under the present invention, at least the first metal magnetic grains are constituted by amorphous alloy. Because at least one group of alloy grains are amorphous alloy grains, core loss can be suppressed. In addition, for the other group of alloy grains, amorphous alloy grains whose average grain size is smaller than that of the one group of alloy grains are used. This way, the fill ratio can be increased further. In particular, the fill ratio can be increased most when the average grain sizes are at least five times different. Even when Fe grains are used for the other group of alloy grains, the fill ratio can still be increased and current characteristics improved further when the average grain sizes are at least five times different. In addition, third (or subsequent) metal magnetic grains may also be contained whose Fe content is different from those of the first metal magnetic grains and second metal magnetic grains.

The type of resin to be included in the composite magnetic material under the present invention is not limited in any way, and any resin used for electronic components, etc., may be used as deemed appropriate; however, preferably it is thermosetting resin, such as epoxy resin, polyester resin, polyimide resin, etc. A magnetic body is formed by this composite magnetic material by applying heat, as its forming does not depend on pressure. In particular, it is better that the viscosity of the resin remains low when heat is applied and that the melting temperature of the resin is 50 to 200° C. Also when the coil uses a sheathed conductive wire, any negative effect on the quality of the coil can be prevented without treating the sheathed conductive wire in any special way, so long as the melting temperature of the resin is 50 to 150° C. Based on the above, novolac epoxy resin can be cited as an example. Also from the viewpoint of ensuring sufficient insulation property while improving the electrical characteristics, preferably the composite magnetic material contains the resin by 5 to 10 percent by weight. Here, containing the resin by more than 10 percent by weight improves the fluidity of the composite magnetic material, but it causes the fill ratio of metal magnetic gains to drop and therefore preferably the resin is contained by no more than 10 percent by weight.

In this Specification, a composition containing the aforementioned metal magnetic grains and resin is conceptually referred to as "composite magnetic material" regardless of its form. For example, the resin in the composite magnetic material may have been cured or not cured yet. If the resin in the composite magnetic material has been cured and the entire composite magnetic material takes a specific solid shape as a result (without being sintered), the composite magnetic material in this state is referred to as "magnetic body." The magnetic body is also an embodiment of the present invention.

Under the present invention, pressure (such that the grains are distorted or deformed as in conventional molding) is not required, i.e., the grains are substantially free of distortion or deformation (e.g., less than 50 MPa), when obtaining the magnetic body, or in other words, curing the resin. For example, the aforementioned metal magnetic grains and uncured thermosetting resin can be poured into a metal mold and heated to a temperature higher than the curing temperature of the resin to cure the resin, thereby solidifying the composite magnetic material itself in a specific shape, to obtain the magnetic body under the present invention. This way, the metal magnetic grains remain free from distortion and drop in performance characteristics can be suppressed. For the method to obtain the magnetic body from the composite magnetic material, any prior art of curing resin, etc., may be referenced as deemed appropriate.

The magnetic body under the present invention is useful as part of a coil component. By forming a coil using an insulating sheathed conductive wire, etc., either on the exterior or interior of the magnetic body under the present invention, the coil component proposed by the present invention can be obtained. The detailed constitution and manufacturing method of the coil component are not limited in any way, and any prior art, etc., may be referenced as deemed appropriate.

EXAMPLES

The present invention is explained more specifically below using examples. It should be noted, however, that the present invention is not limited to the embodiments described in these examples.

Example 1

A coil component was manufactured as follows.

Product size: 2.5×2.0×1.2 mm

Minimum thickness of magnetic body: 0.25 mm

Metal magnetic grains: FeSiCr (Powder of 15 μm in average grain size was produced in air according to the water atomization method by mixing Fe, Si, and Cr at a ratio of 92.5 percent by weight, 4 percent by weight, and 3.5 percent by weight, respectively, and the produced powder was heat-treated for one hour in a reducing ambience of 500° C. The resulting metal magnetic grains are referred to as crystalline alloy grains c.)

Resin: Epoxy resin, 3 percent by weight

Hollow coil: Rectangular wire with polyimide sheath (0.3×0.1 mm), α-wound by 9.5 turns Forming: The hollow coil was placed in a metal mold, and the composite magnetic material was poured into the metal mold that had been heated to 150° C., and then temporarily cured, to form the magnetic body.

Curing: The temporarily cured magnetic body was taken out of the metal mold and cured at 200° C.

Terminal electrodes: The magnetic body was polished to expose the ends of the hollow coil, which were then given Ag sputtering and then coated with Ag-containing conductive paste and plated with Ni and Sn.

The above procedure was carried out as follows.

The coil was produced and placed in the metal mold in a manner aligning the center of the mold with the center of the hollow coil. The composite magnetic material prepared beforehand by mixing the metal magnetic grains and resin was heated to 150° C., and this 150° C.-hot composite magnetic material was poured into the metal mold to obtain the base of magnetic body. Thereafter, the resin was cured further at 200° C. to obtain the magnetic body. This magnetic body was processed as necessary (cut, polished and rust-proofed) and eventually the terminal electrodes were formed to obtain the coil component. The molding pressure used here was 15 MPa, which is very low compared to the pressures traditionally used.

Comparative Example 1

A coil component was obtained in the same manner as in Example 1, except that FeSiCr that had not been given the heat treatment in a reducing ambience was used for the metal magnetic grains. The resulting metal magnetic grains are referred to as crystalline alloy grains a.

Comparative Example 2

A coil component was obtained in the same manner as in Example 1, except for the metal magnetic grains. For the metal magnetic grains, FeSiAlCr powder of 15 μm in average grain size was produced in air according to the water atomization method by mixing Fe, Si, Al, and Cr at a ratio of 90 percent by weight, 5 percent by weight, 4 percent by weight, and 1 percent by weight, respectively, and the produced powder was heat-treated for one hour in a reducing ambience of 500° C. The resulting metal magnetic grains are referred to as crystalline alloy grains b.

Comparative Example 3

A coil component was obtained in the same manner as in Example 1, except for the metal magnetic grains. For the metal magnetic grains, FeSiCrBC powder of 15 μm in average grain size was produced in air according to the water atomization method by mixing Fe, Si, Cr, B, and C at a ratio of 70 percent by weight, 8 percent by weight, 5 percent by weight, 15 percent by weight, and 2 percent by weight, respectively. The resulting metal magnetic grains are referred to as amorphous alloy grains d.

Example 2

A coil component was obtained in the same manner as in Example 1, except for the metal magnetic grains. For the metal magnetic grains, FeSiCrBC powder of 15 μm in average grain size was produced in air according to the water atomization method by mixing Fe, Si, Cr, B, and C at a ratio of 77 percent by weight, 6 percent by weight, 4 percent by weight, 13 percent by weight, and 2 percent by weight, respectively. The resulting metal magnetic grains are referred to as amorphous alloy grains e.

Example 3

A coil component was obtained in the same manner as in Example 1, except for the metal magnetic grains. For the metal magnetic grains, FeSiBC powder of 15 μm in average grain size was produced in air according to the water atomization method by mixing Fe, Si, B, and C at a ratio of 79.5 percent by weight, 5 percent by weight, 13.5 percent by weight, and 2 percent by weight, respectively. The resulting metal magnetic grains are referred to as amorphous alloy grains f.

Example 4

A coil component was obtained in the same manner as in Example 1, except for the metal magnetic grains. For the metal magnetic grains, amorphous alloy grains f used in Example 3 and amorphous alloy grains e used in Example 2 prepared to a different average grain size of 10 μm were mixed at a ratio of 6:4, respectively, for use as the composite magnetic material.

Example 5

Here, a coil component was obtained using the same composite magnetic material used in Example 4, by changing the product height to 1.0 mm and the minimum thickness of the magnetic body to 0.2 mm.

Example 6

A coil component was obtained in the same manner as in Example 5, except for the metal magnetic grains. For the metal magnetic grains, amorphous alloy grains f used in Example 3 and amorphous alloy grains e used in Example 2 prepared to a different average grain size of 10 μm were mixed at a ratio of 8:2, respectively, for use as the composite magnetic material.

Example 7

A coil component was obtained in the same manner as in Example 5, except for the metal magnetic grains. For the metal magnetic grains, amorphous alloy grains f used in Example 3 and amorphous alloy grains e used in Example 2 prepared to a different average grain size of 10 μm were mixed at a ratio of 9:1, respectively, for use as the composite magnetic material.

Example 8

A coil component was obtained in the same manner as in Example 5, except for the metal magnetic grains. For the metal magnetic grains, amorphous alloy grains f used in Example 3 and amorphous alloy grains e used in Example 2 prepared to a different average grain size of 2 μm were mixed at a ratio of 8:2, respectively, for use as the composite magnetic material.

Example 9

A coil component was obtained in the same manner as in Example 5, except for the metal magnetic grains. For the metal magnetic grains, amorphous alloy grains f used in Example 3 and amorphous alloy grains e used in Example 2 prepared to a different average grain size of 1.5 μm were mixed at a ratio of 8:2, respectively, for use as the composite magnetic material.

Example 10

A coil component was obtained in the same manner as in Example 5, except for the metal magnetic grains. For the metal magnetic grains, amorphous alloy grains f used in Example 3 and Fe grains (containing Fe by 99.6 percent by weight and impurities for the rest) of 1.5 μm in average grain size were mixed at a volume ratio of 8:2, respectively, for use as the composite magnetic material.

The SIMS measurement results of the metal magnetic grains contained in the composite magnetic materials are as follows:

| Metal magnetic grains | Oxygen atom concentration in surface |
|---|---|
| Crystalline alloy grains a | 53% |
| Crystalline alloy grains b | 52% |
| Crystalline alloy grains c | 48% |
| Amorphous alloy grains d | 51% |
| Amorphous alloy grains e | 40% |
| Amorphous alloy grains f | 30% |
| Fe grains | 31% |

In the foregoing, the "oxygen atom concentration in surface" indicates the maximum value of oxygen atom concentration obtained by SIMS measurement as mentioned above (specifically the maximum value among the measurements taken at different etching times from 0 to 10 minutes in 1-minute increments).

For each composite magnetic material, the SIMS measurement covered 20 grains.

The averages of measured results are shown above.

The fill ratio in the composite magnetic materials and the inductances of the coil components are as follows:

| | Fill ratio | Inductance |
|---|---|---|
| Example 1 | 74.0 vol % | 1.02 μH |
| Comparative Example 1 | 70.3 vol % | 0.8 μH |
| Comparative Example 2 | 71.2 vol % | 0.85 μH |
| Comparative Example 3 | 71.3 vol % | 0.86 μH |
| Example 2 | 75.2 vol % | 1.1 μH |
| Example 3 | 75.4 vol % | 1.12 μH |
| Example 4 | 75.8 vol % | 1.15 μH |
| Example 5 | 75.5 vol % | 1.04 μH |
| Example 6 | 76.4 vol % | 1.1 μH |
| Example 7 | 76.1 vol % | 1.07 μH |
| Example 8 | 77.3 vol % | 1.1 μH |

-continued

| | Fill ratio | Inductance |
|---|---|---|
| Example 9 | 75.5 vol % | 1.02 μH |
| Example 10 | 75.5 vol % | 1.02 μH |

In the foregoing, the "fill ratio" indicates the percentage of the area occupied by the metal magnetic grains in a section of the magnetic body based on microscopic image observation (the fill ratio is different from the amount of resin which refers to the amount of resin added when the composite magnetic material was manufactured).

The "inductance" indicates the inductance value of the coil component at 1 MHz obtained using a LCR meter.

All comparative examples resulted in a low fill ratio, suggesting defects (exposed conductive wire) due to insufficient filling around the coil. As a result, the electrical characteristics in all comparative examples were also lower than those in the examples, and were insufficient for a coil component. As is evident from these results, a magnetic body having thin parts could not be formed before. In the examples, on the other hand, a magnetic body of 0.25 mm, or even 0.2 mm, in thickness could be obtained without filling defects. Consequently, a smaller component can be produced with a level of thinness not heretofore achievable with powder compacting with high molding pressure.

Example 11

In this example, a wire was wound around a drum core and a composite magnetic material was formed on the exterior of the winding.

Product size: 2.5×2.0×1.2 mm

Drum core: FeSiCr (Fe, Si, and Cr were mixed at a ratio of 90 percent by weight, 6 percent by weight, and 4 percent by weight, respectively, and the mixture was heat-treated in air for one hour.)

Composite magnetic material: Amorphous alloy grains e above were used.

Coil: Conductive wire with polyimide sheath (rectangular wire 0.3×0.1 mm), α-wound by 9.5 turns Forming: The drum core with the winding was placed in a rubber mold, and the composite magnetic material was poured into the rubber mold and then temporarily cured to form the magnetic body.

Curing: The temporarily cured magnetic body was taken out of the rubber mold and cured at 200° C.

Terminal electrodes: The exterior surfaces of the flanges of the drum core were given Ti and Ag sputtering and then coated with Ag-containing conductive paste and plated with Ni and Sn.

The above procedure was carried out as follows.

The drum core was produced by forming and heat-treating the FeSiCr magnetic material. Next, terminal electrodes were formed on the exterior surfaces of the flanges of the drum core and the conductive wire wound externally around the shaft of the drum core was connected to the terminal electrodes. Lastly, the drum core with the winding was placed in a rubber mold and the composite magnetic material prepared beforehand by mixing the metal magnetic grains and resin was heated to 50° C. and molded on the exterior of the coil, after which the obtained coil component was taken out of the rubber mold and the resin was cured further at 200° C., to obtain the coil component. The molding pressure used here was 5 MPa, which is very low compared to the pressures traditionally used.

When the coil component was evaluated in the same manner as described above, the measured inductance was 1.15 μH and fill ratio was 74.5 percent by volume, indicating good current characteristics. This suggests that a stable component free from filling defects can be produced.

As shown, a magnetic body can be made thinner than ever possible, and a component smaller in size and higher in performance than ever possible can be manufactured, using the composite magnetic material proposed by the present invention.

The evaluations made other than those of electrical characteristics are described below.

Each composite magnetic material can be evaluated based on its section. For the fill ratio of metal magnetic grains, a scanning electron microscope (SEM) was used to obtain a SEM image (3000 times) which was then processed. In the obtained section, the area occupied by metal magnetic grains and area not occupied by metal magnetic grains were identified and the ratio of the area occupied by metal magnetic grains was used as the fill ratio. In the section, metal magnetic grains were discriminated based on presence/absence of oxygen, and those visible grains in the section with a size (maximum length) of 1 μm or more were considered metal magnetic grains. This range was adopted because metal magnetic grains of less than 1 μm in grain size would have little effect on the magnetic characteristics.

The content of iron (Fe element) in the metal magnetic grain can also be measured by SEM-EDX. A SEM image (3000 times) of a section of the composite magnetic material was obtained and grains of the same composition were selected by mapping, and then an average content of iron (elemental Fe) was obtained from at least 20 metal magnetic grains. If grains of different compositions are found by mapping, it can be judged that metal magnetic grains of different compositions have been mixed in. Also, for the grain size of metal magnetic grains, a SEM image (approx. 30000 times) of a section of the composite magnetic material was obtained and at least 300 average-sized grains were selected in the measured area, and then the area occupied by these grains was measured in the SEM image to calculate the grain size by assuming that the grains are spherical. If the obtained grain size distribution shows two peaks, it can be judged that metal magnetic grains of a different average grain size have been mixed in. All measurements were performed by selecting the center area of the section of the magnetic body formed with the composite magnetic material. In addition, all measurements were taken by selecting visible grains in the section with a size of 1 μm or more.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

It will be understood by those of skill in the art that numerous and various modifications can be made without departing from the spirit of the present invention. Therefore, it should be clearly understood that the forms of the present invention are illustrative only and are not intended to limit the scope of the present invention.

I claim:

1. A coil component constituted by a composite magnetic material containing magnetic alloy grains and resin and also by a coil, wherein a maximum oxygen atom concentration within an exposed outermost region, referred to as a surface layer, of the magnetic alloy grains which is a part of the magnetic alloy grains is more than 0 percent but 50 percent or less, and an oxygen atom concentration at a surface of the surface layer is lower than the maximum oxygen atom concentration and more than 0 percent but 25 percent or less, said magnetic alloy grains comprised of first alloy grains and second alloy grains which have different compositions and different average grain sizes wherein the first and second alloy grains constitute a grain size distribution which shows two peaks.

2. A coil component according to claim 1, wherein at least the first alloy grains are amorphous alloy grains.

3. A coil component according to claim 2, wherein the amorphous alloy grains contain 77 to 79.5 percent by weight of Fe.

4. A coil component according to claim 3, wherein the amorphous alloy grains further contain 5 to 10 percent by weight of at least one metal selected from the group consisting of Si, Al, Cr, Ni, Mo, and Co.

5. A coil component according to claim 1, wherein the first alloy grains have a smaller average grain size than the second alloy grains, and account for 10 to 40 percent by volume among all the alloy grains.

6. A coil component according to claim 1, wherein all the alloy grains have a size of at least 1 μm.

7. A coil component according to claim 1, wherein the oxygen atom concentration is measured by secondary ion mass spectrometry.

8. A coil component according to claim 1, wherein the coil is embedded in the composite magnetic material.

9. A coil component according to claim 1, wherein the coil is formed inside the composite magnetic material.

10. A coil component according to claim 1, wherein an average grain size of the first and second alloy grains is in a range of from 2 to 20 μm.

11. A coil component according to claim 1, wherein at least the second alloy grains are crystalline alloy grains containing 92.5 to 95.5 percent by weight of Fe.

12. A coil component according to claim 11, wherein the crystalline alloy grains further contain 5 to 10 percent by weight of at least one metal selected from the group consisting of Si, Al, Cr, Ni, Mo, and Co.

13. A coil component according to claim 1, wherein the alloy grains having an oxygen atom concentration of 50% or less in their surface layers account for 80 percent by volume or more in equivalent volume percentage, among all of the alloy grains contained in the composite magnetic material.

14. A coil component according to claim 1, wherein the composite magnetic material is shaped by curing of the resin without distortion or deformation of the alloy grains.

15. A coil component constituted by a composite magnetic material containing magnetic alloy grains and resin and also by a coil, wherein a maximum oxygen atom concentration within an exposed outermost region, referred to as a surface, of the magnetic alloy grains which is a part of the magnetic alloy grains is 50 percent or less, said magnetic alloy grains comprised of first alloy grains and second alloy grains which have different compositions and different average grain sizes wherein the first and second alloy grains constitute a grain size distribution which shows two peaks, wherein the oxygen atom concentration is 30 to 40 percent.

16. A coil component according to claim 15, wherein the alloy grains having an oxygen atom concentration of 30% to 40% in their surfaces account for 80 percent by volume or more in equivalent volume percentage, among all of the alloy grains contained in the composite magnetic material.

* * * * *